US010623847B2

(12) United States Patent
Jiang

(10) Patent No.: US 10,623,847 B2
(45) Date of Patent: Apr. 14, 2020

(54) HEADPHONE WITH MULTIPLE ACOUSTIC PATHS

(71) Applicant: EVA Automation, Inc., Redwood City, CA (US)

(72) Inventor: Chen Jiang, Worthing (GB)

(73) Assignee: EVA Automation, Inc., Menlo Park, CA (US)

( * ) Notice: Subject to any disclaimer, the term of this patent is extended or adjusted under 35 U.S.C. 154(b) by 0 days.

(21) Appl. No.: 16/053,782

(22) Filed: Aug. 2, 2018

(65) Prior Publication Data

US 2020/0045402 A1 Feb. 6, 2020

(51) Int. Cl.

*H04R 25/00* (2006.01)
*H04R 1/10* (2006.01)
*H04R 1/28* (2006.01)

(52) U.S. Cl.

CPC ..... *H04R 1/1075* (2013.01); *H04R 1/1008* (2013.01); *H04R 1/1083* (2013.01); *H04R 1/2826* (2013.01); *H04R 2460/11* (2013.01)

(58) Field of Classification Search

CPC .. H04R 1/1075; H04R 1/1008; H04R 1/1083; H04R 1/2826

USPC ..... 381/372, 380, 385, 373

See application file for complete search history.

(56) References Cited

U.S. PATENT DOCUMENTS 3,246,721 A * 4/1966 Martin ..... H04R 1/225 181/160
3,798,393 A * 3/1974 Gorike ..... H04R 1/1008 381/347
4,005,278 A * 1/1977 Gorike ..... H04R 5/033 181/137
4,742,887 A * 5/1988 Yamagishi ..... H04R 1/2857 181/129
5,949,897 A * 9/1999 Bartels ..... H04R 3/00 381/372
6,134,336 A * 10/2000 Clark ..... H04M 1/03 381/371
9,319,767 B2 * 4/2016 Sakaguchi ..... H04R 1/2811
9,602,912 B2 * 3/2017 Wen ..... H04R 1/24
9,838,777 B2 * 12/2017 Kuwahara ..... H04R 1/1016
9,883,280 B2 * 1/2018 Oosato ..... H04R 1/2826
10,034,076 B2 * 7/2018 Matsuo ..... H04R 11/02
10,117,017 B2 * 10/2018 Kuwahara ..... H04R 1/1016
10,171,905 B2 * 1/2019 Wen ..... H04R 1/1075
2008/0013773 A1 * 1/2008 Yang ..... H04R 1/2826 381/379
2015/0055814 A1 * 2/2015 Liu ..... H04R 1/1075 381/373
2016/0192065 A1 * 6/2016 Oosato ..... H04R 1/2826 381/378
2017/0230741 A1 * 8/2017 Matsuo ..... H04R 11/02

* cited by examiner

*Primary Examiner* — Phylesha Dabney
(74) *Attorney, Agent, or Firm* — Steven Stupp

(57) ABSTRACT

Headphones comprising a first acoustic path configured to provide passive noise cancellation, and a second acoustic path configured to provide audio leaking. At least a part of the first acoustic path is different from at least a part of the second acoustic path.

20 Claims, 3 Drawing Sheets

HEADPHONE WITH MULTIPLE ACOUSTIC PATHS

TECHNICAL FIELD

The present disclosure relates to headphones. In particular, but not exclusively, the present disclosure relates to headphones having dual-acoustic paths.

BACKGROUND

FIG. 1 shows some known headphones 100. Headphones 100 include a front volume 110 formed at one side by the user's ear/head 112 which the driver/speaker of the headphones fires sound into, a driver unit 114 which produces the sound, a rear housing 116, an acoustic resistance $R_0$ which balances audio and passive noise isolation (or 'passive noise cancellation') performance, and a driver plate 118 on which a driver is mounted. Headphones 100 may include an acoustic resistance $R_5$ to balance the air pressure between front volume 110 and rear volume 118 to reduce the occlusion effect when the headphones are put on the head of a user. Headphones 100 may comprise cushioning 122 for comfortable fitting of the headphones on the user's head.

Noise isolation performance of known headphones 100 depicted in FIG. 1 is dominated by the acoustic path from acoustic resistance $R_0$ to front volume 110. A noise pressure of $P_0$ in the ambient environment 106 outside headphones 100 results in a noise pressure of $P_4$ in rear volume 118 after passing through acoustic resistance $R_0$. In order to acquire a good noise isolation performance, a dense acoustic resistance $R_0$ is required but the denser the material, the worse the audio performance (especially bass audio performance) is. So, in such known headphones, a good audio (bass) performance contradicts with good noise isolation performance.

Acoustic resistance $R_0$ and acoustic resistance $R_5$ typically comprise acoustic resistive material such as woven mesh, paper mesh or foam material.

SUMMARY

According to embodiments, there are headphones comprising:

a first acoustic path configured to provide passive noise cancellation; and a second acoustic path configured to provide audio leaking, wherein at least a part of the first acoustic path is different from at least a part of the second acoustic path.

According to embodiments, there are headphones comprising:

a first acoustic path configured to provide passive noise cancellation;

a second acoustic path configured to provide audio leaking; and a rear volume, wherein a bass port part of the second acoustic path is directly exposed to the ambient environment without passing via the rear volume.

According to embodiments, there are headphones comprising:

a first acoustic path configured to provide passive noise cancellation; and a second acoustic path configured to provide audio leaking, wherein the first acoustic path comprises a relatively high acoustic resistance and the second acoustic path comprises a relatively low acoustic resistance.

Features described in relation to one embodiment of the present disclosure may be incorporated into other embodiments of the present disclosure. For example, the method of one or more embodiments may incorporate any of the features described with reference to the apparatus of one or more embodiments and vice versa.

DESCRIPTION OF THE DRAWINGS

Embodiments of the present disclosure will now be described by way of example only with reference to the accompanying schematic drawings of which.

DETAILED DESCRIPTION

Embodiments provide headphones having dual-acoustic paths which provide good audio performance as well as good passive noise isolation performance.

Passive isolation performance herein refers to the amount of noise the headphones block from the ambient environment.

Audio performance herein refers to preservation of the quality of audio produced by a driver unit (or 'speaker unit') of the headphones.

Figure 1:
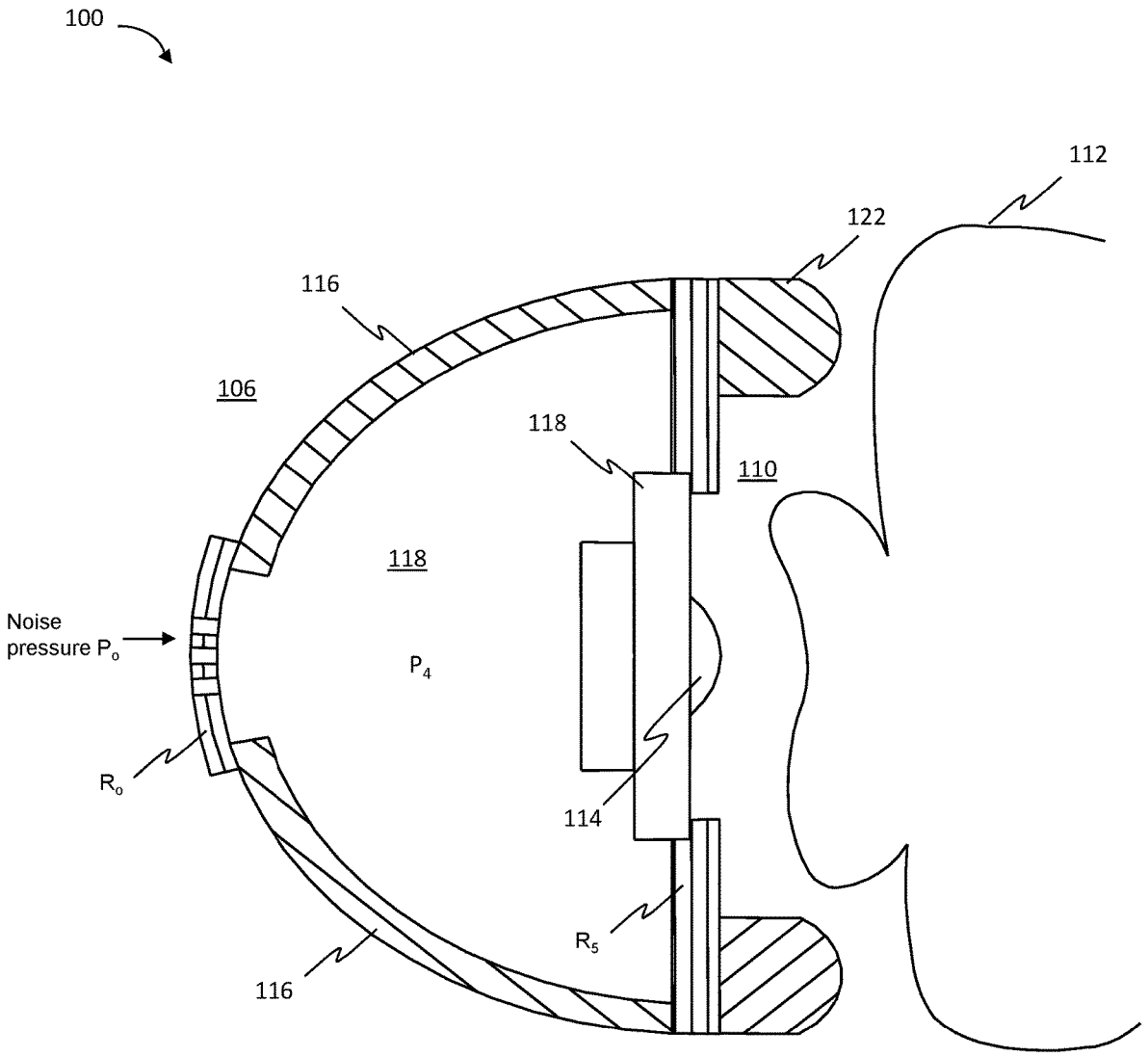
FIG. 1 PRIOR ART
FIG. 1 shows a cross-section view of some headphones according to the prior art.
Figure 2:
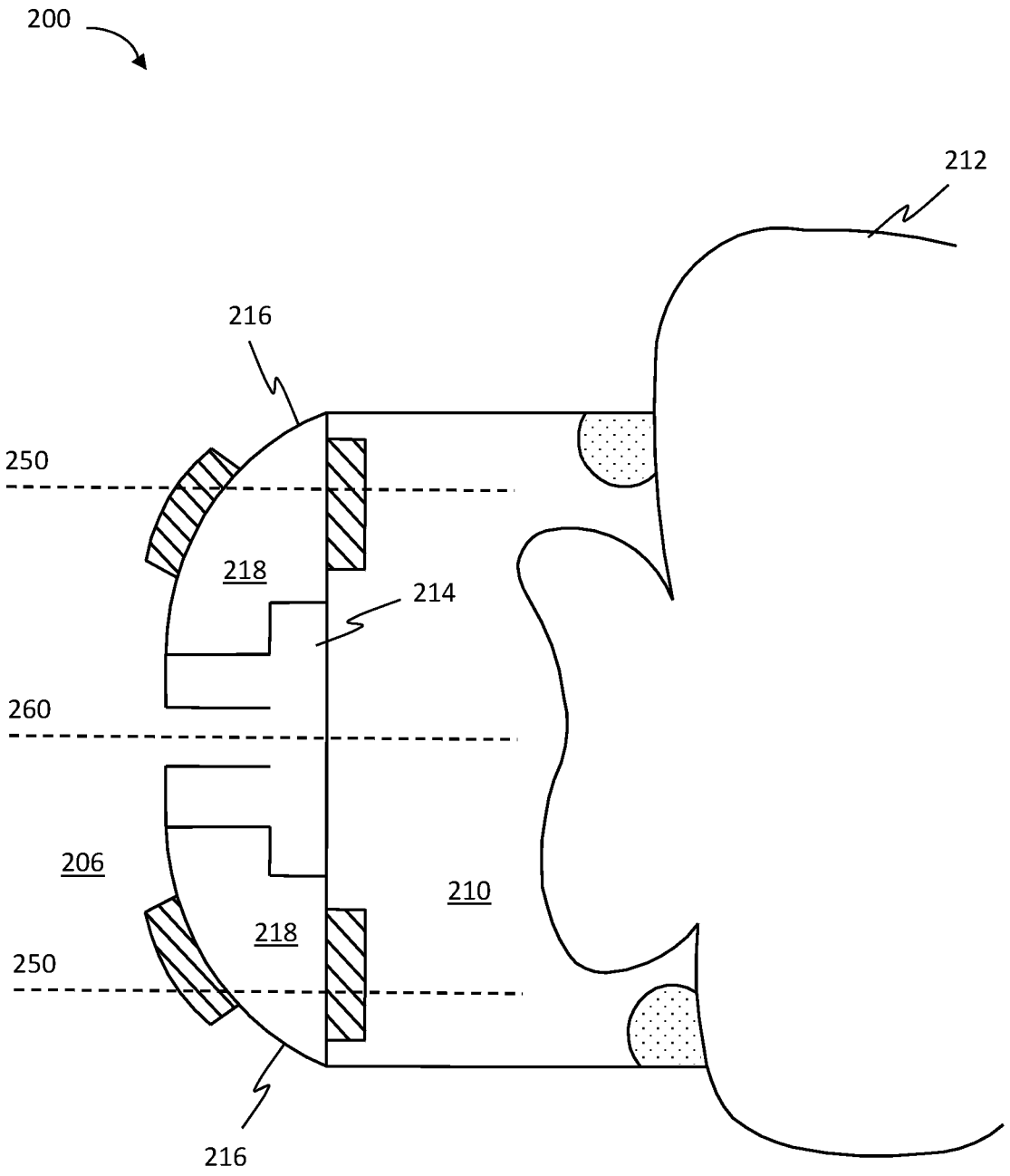
FIG. 2 shows a cross-section view of some headphones according to embodiments.

FIG. 2 shows some headphones 200 according to embodiments. Headphones 200 include a front volume 210 formed at one side by the user's ear/head 212, a driver unit 214, a rear housing 216 and a rear volume 218. Only a single side (or 'cup') of headphones 200 is depicted in FIG. 2 for clarity.

Headphones 200 comprise a first acoustic path 250 configured to provide passive noise cancellation and a second acoustic path 260 configured to provide audio leaking. At least a part of first acoustic path 250 is different from at least a part of second acoustic path 260.

In embodiments, second acoustic path 260 passes from front volume 210 through driver unit 214 to the ambient environment 206.

In embodiments, second acoustic path 260 passes directly from front volume 210 through a bass port of driver unit 214 to ambient environment 206.

In embodiments, second acoustic path 260 does not pass through rear volume 218.

Figure 3:
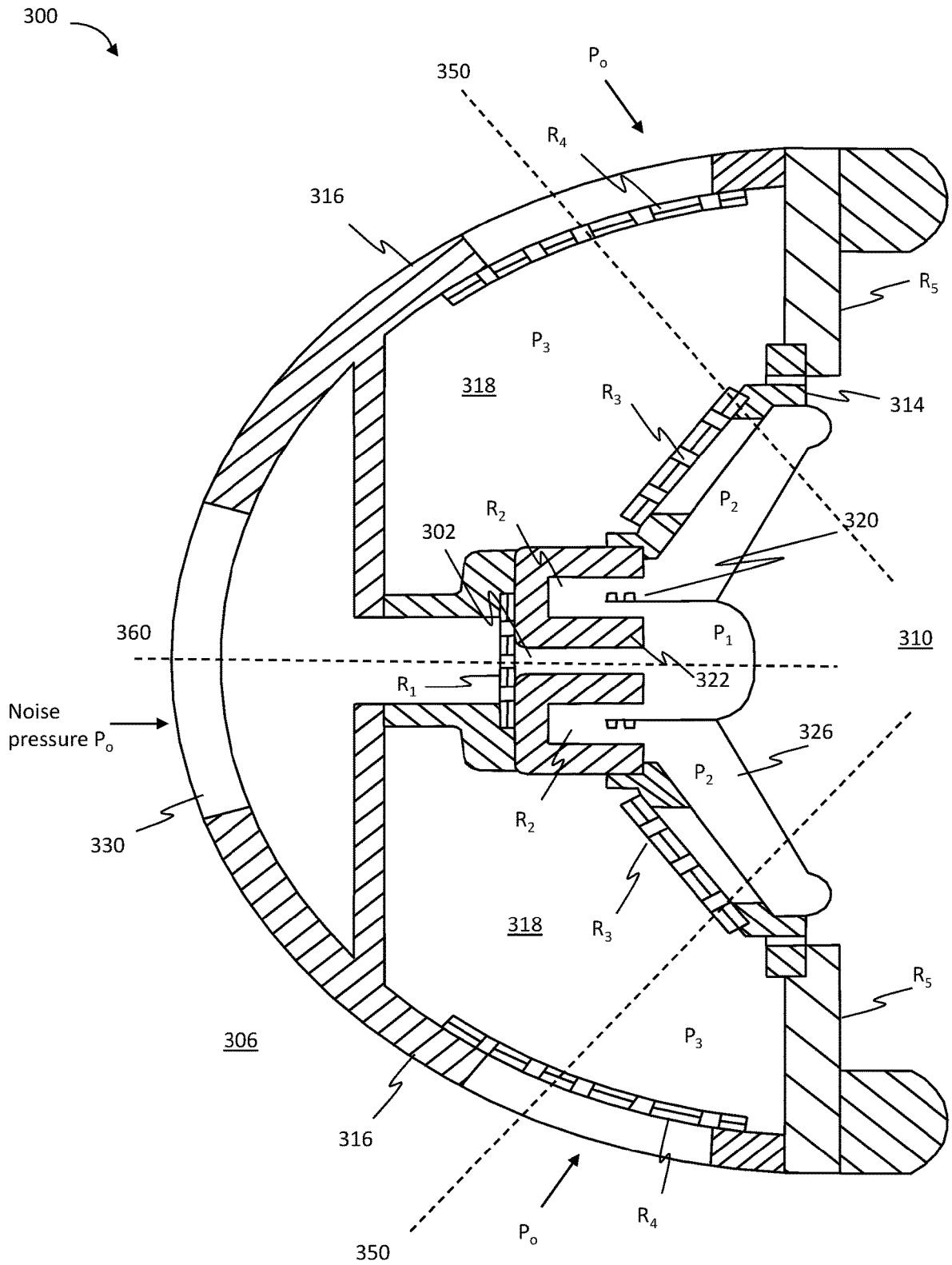
FIG. 3 shows a cross-section view of some headphones according to embodiments.

FIG. 3 shows some headphones 300 according to embodiments. Headphones 300 include a front volume 310 formed at one side by the user's ear/head (not shown), a driver unit 314, a rear housing 316 and a rear volume 318. Only a single side (or 'cup') of headphones 300 is depicted in FIG. 3 for clarity.

Headphones 300 comprise a first acoustic path 350 configured to provide passive noise cancellation and a second acoustic path 360 configured to provide audio leaking. At least a part of first acoustic path 350 is different from at least a part of second acoustic path 360.

Driver unit 314 comprises a driver port 302. The second acoustic path comprises driver port 302. Driver port 302 may for example comprise a bass port. In embodiments, front volume 310 is separated from the ambient environment 306 at least in part by the bass port. In embodiments, the bass port is comprised in second acoustic path 360. In embodiments, the bass port is not comprised in first acoustic path 350.

In embodiments, the second acoustic path comprises a first acoustic resistance $R_1$. In embodiments, driver port 302 is exposed to ambient environment 306 via first acoustic resistance $R_1$. In embodiments, driver port 302 is exposed to ambient environment 306 without passing via rear volume 318. Exposing the driver port to the ambient environment means that the driver can move more freely which assists in preserving the audio quality.

In embodiments, the second acoustic path comprises a second acoustic resistance $R_2$ formed at least in part by an air gap between a voice coil 320 of driver unit 314 and a magnetic system 322 of driver unit 314.

In embodiments, headphones 300 comprise a third acoustic resistance $R_3$ between driver unit 314 and rear volume 318.

In embodiments, driver unit 314 comprises a diaphragm 326. In some such embodiments, third acoustic resistance $R_3$ is formed between diaphragm 326 and rear volume 318.

In embodiments, first acoustic path 350 comprises a fourth acoustic resistance $R_4$ formed between ambient environment 306 and rear volume 318.

In embodiments, fourth acoustic resistance $R_4$ is greater than third acoustic resistance $R_3$.

In embodiments, third acoustic resistance $R_4$ is greater than fourth acoustic resistance $R_3$.

In embodiments, first acoustic resistance $R_1$ is zero (for example due to the absence of an acoustic mesh). In embodiments, first acoustic resistance $R_1$ is approximately zero (for example due to presence of a very thin/sparse acoustic mesh).

In embodiments, fourth acoustic resistance $R_4$ is greater than first acoustic resistance $R_1$. In embodiments, fourth acoustic resistance $R_4$ is much greater than first acoustic resistance $R_1$.

In embodiments, front volume 310 is separated from rear volume 318 at least in part by driver unit 314.

In embodiments, front volume 310 is separated from rear volume 318 at least in part by a fifth acoustic resistance $R_5$.

In embodiments, headphones 300 comprise a dirt guard 330. In embodiments, dirt guard 330 is removed. In embodiments, dirt guard 330 comprises a very light or thin (i.e. not dense) mesh or grille.

Separating the driver (bass) port and rear volume according to embodiments, enables a good noise isolation performance but also preserves the audio quality (for example bass quality) of audio produced by the driver unit of the headphones.

In embodiments, the bass performance of the headphones is dominated by the bass port which is not constrained by the rear volume. In embodiments, noise isolation performance is dominated by the acoustic path from the bass port through the voice coil gap and acoustic resistance $R_3$ to the front volume.

The two acoustic paths of embodiments help to achieve a good noise isolation performance whilst maintaining a good audio response, in particular a good bass response.

Embodiments involve separating the driver bass port from the rear volume such that the headphones function through the rear volume with a very high acoustic resistance $R_4$ (for example a very dense acoustic mesh) for noise isolation purposes.

In some embodiments, fourth acoustic resistance $R_4$ is removed and the vacated area covered over by the rear housing (in other words, $R_4$ is extremely high).

The dual acoustic paths of embodiments avoid the trade-off between conflicting noise isolation and audio leaking constraints in prior art headphones.

In some embodiments, third acoustic resistance $R_3$ is removed (in other words, $R_3$ is zero or negligible).

In embodiments, fourth acoustic resistance $R_4$ of embodiments is much greater than acoustic resistance $R_0$ of prior art headphones. The headphones of embodiments can therefore provide better noise isolation than prior art headphones.

In embodiments, in use, noise pressure $P_0$ is transmitted through fourth acoustic resistance $R_4$ which results in a pressure of $P_3$ in rear volume 318. As fourth acoustic resistance $R_4$ is very high, in the limit, $P_3$ tends to zero. In other words, in embodiments, noise pressure $P_3$ due to ambient noise pressure $P_0$ is much less than the ambient noise pressure $P_0$.

In embodiments, first acoustic resistance $R_1$ is much less than acoustic resistance $R_0$ present on the outer of the rear volume of prior art headphones (in the limit, first acoustic resistance $R_1$ is zero, i.e. no acoustic mesh is present, or negligible). The pressure transmitted through first acoustic resistance $R_1$ is $P_1$, which when transmitted through second acoustic resistance $R_2$ produces pressure $P_2$ (which can be referred to as the inner diaphragm pressure).

In some embodiments, inner diaphragm pressure $P_2$ of embodiments is similar to rear volume pressure $P_4$ of prior art headphones such that noise isolation performance is similar. This means that embodiments can provide good noise isolation performance similar to prior art headphones, but due to first acoustic resistance $R_1$ being relatively small, embodiments can also provide good audio leakage (for example good bass performance). This is in contrast to prior art headphones where only one of good noise isolation (high $R_4$) and good audio leakage (low $R_4$) is possible, but not both as in embodiments described herein.

Embodiments comprise headphones comprising a first acoustic path configured to provide passive noise cancellation, and a second acoustic path configured to provide audio leaking; in some such embodiments, a bass port part of the second acoustic path is directly exposed to the ambient environment. Exposing the bass port directly to the ambient environment means that the driver can move more freely which assists in preserving the bass audio quality.

Embodiments comprise headphones comprising a first acoustic path configured to provide passive noise cancellation, a second acoustic path configured to provide audio leaking, and a rear volume; in some such embodiments, a bass port part of the second acoustic path is directly exposed to the ambient environment without passing via the rear volume.

Embodiments comprise headphones comprising a first acoustic path configured to provide passive noise cancellation, and a second acoustic path configured to provide audio leaking; in some such embodiments, the first acoustic path has a first acoustic resistance that is relatively larger than a second acoustic resistance of the second acoustic path Embodiments comprise headphones comprising a first noise cancellation path and a separate, second audio leaking path.

Whilst the present disclosure has been described and illustrated with reference to particular embodiments, it will be appreciated by those of ordinary skill in the art that the disclosure lends itself to many different variations not specifically illustrated herein. By way of example only, certain possible variations will now be described.

The above embodiments describe headphones having dual-acoustic paths. In alternative embodiments, more than two acoustic paths may be employed, for example multiple noise cancellation paths and/or multiple audio leaking paths and/or multiple other acoustic paths.

An acoustic path comprises herein may comprise one or more solid structural components, one or more air gap/channel/tunnel components, and/or a combination of solid structural and air gap/channel/tunnel components.

In FIG. 3, second acoustic path 360 is depicted as a straight line for clarity purposes; in reality, second acoustic path 360 will also pass in/around other components such as voice coils 320, magnet system 322, etc.

The headphones embodiments of FIGS. 2 and 3 are depicted as on-ear (or 'circumaural') headphones. Embodiments equally apply to other types of headphones such as in-ear headphones, earbud headphones or over-ear headphones.

FIGS. 2 and 3 depict a single side of headphones; the headphones may comprise two sides (one for each ear of a user), or may comprise just a single side.

The headphones of embodiments may comprise wireless headphones, wired headphones, hi-fi headphones, and/or may comprise active noise cancellation functionality.

Example values of acoustic resistances $R_1$ to $R_5$ in some embodiments are as follows:

$R_1$<1e4 kg/($m^4$ s) @ 1 KHz $R_2$>1e5 kg/($m^4$ s) @ 1 KHz $R_3$<$R_4$ $R_4$>3e4 kg/($m^4$ s) @ 1 KHz $R_5$>1e3 kg/($m^4$ s) @ 1 KHz

Note that the above values for $R_1$ to $R_5$ are typical and/or approximate values and given as illustrative examples only; other values can be used in other embodiments.

In embodiments, cushioning 122 may be configured such that each side/cup of the headphones is free to rotate about 1 or 2 axes relative to a headband component connecting each side/cup to the other. Such rotation helps maintain the cups against the head of the user and so helps maintain passive noise cancellation.

Where in the foregoing description, integers or elements are mentioned which have known, obvious or foreseeable alternatives or equivalents, then such alternatives or equivalents are herein incorporated as if individually set forth. Reference should be made to the claims for determining the true scope of the present disclosure, which should be construed so as to encompass any such alternatives. It will also be appreciated by the reader that integers or features of the present disclosure that are described as preferable, advantageous, convenient or the like are optional and do not limit the scope of the independent claims. Moreover, it is to be understood that such optional integers or features, whilst of possible benefit in some embodiments, may not be desirable, and may therefore be absent, in other embodiments.

What is claimed is:

1. Headphones comprising:

a first acoustic path configured to provide passive noise cancellation;

a second acoustic path configured to provide audio leaking, wherein at least a part of the first acoustic path is different from at least a part of the second acoustic path; and a rear volume, wherein the second acoustic path is exposed to the ambient environment without passing via the rear volume, and wherein the first acoustic path and the second acoustic path are located on a same side of the headphones.

2. The headphones of claim 1, comprising a driver unit, wherein the driver unit comprises a driver port, and wherein the second acoustic path comprises the driver port.

3. The headphones of claim 2, wherein the driver port comprises a bass port.

4. The headphones of claim 2, wherein the second acoustic path comprises a first acoustic resistance, and wherein the driver port is exposed to the ambient environment via the first acoustic resistance.

5. The headphones of claim 4, wherein the first acoustic resistance is zero or approximately zero.

6. The headphones of claim 4, wherein the first acoustic path comprises a fourth acoustic resistance formed between the ambient environment and the rear volume, wherein the fourth acoustic resistance is greater than the first acoustic resistance.

7. The headphones of claim 1, comprising a driver unit, wherein the second acoustic path comprises a second acoustic resistance formed at least in part by an air gap between a voice coil of the driver unit and a magnetic system of the driver unit.

8. The headphones of claim 1, comprising a driver unit, wherein the headphones comprise a third acoustic resistance between the driver unit and the rear volume.

9. The headphones of claim 8, wherein the driver unit comprises a diaphragm, and wherein the third acoustic resistance is formed between the diaphragm and the rear volume.

10. The headphones of claim 1, wherein the first acoustic path comprises a fourth acoustic resistance formed between the ambient environment and the rear volume.

11. The headphones of claim 10, comprising a driver unit, wherein the headphones comprise a third acoustic resistance between the driver unit and the rear volume, and wherein the fourth acoustic resistance is greater than the third acoustic resistance.

12. The headphones of claim 11, wherein the driver unit comprises a diaphragm, wherein the third acoustic resistance is formed between the diaphragm and the rear volume.

13. The headphones of claim 1, comprising:

a front volume; and a driver unit, wherein the front volume is separated from the rear volume at least in part by the driver unit.

14. The headphones of claim 13, wherein the front volume is separated from the rear volume at least in part by a fifth acoustic resistance.

15. The headphones of claim 13, wherein the driver unit comprises a bass port, wherein the front volume is separated from the ambient environment at least in part by the bass port.

16. The headphones of claim 15, wherein the bass port is comprised in the second acoustic path.

17. The headphones of claim 15, wherein the bass port is not comprised in the first acoustic path.

18. Headphones comprising:

a first acoustic path configured to provide passive noise cancellation;

a second acoustic path configured to provide audio leaking, wherein the first acoustic path has a first acoustic resistance that is relatively larger than a second acoustic resistance of the second acoustic path; and a rear volume, wherein the second acoustic path is exposed to the ambient environment without passing via the rear volume, and wherein the first acoustic path and the second acoustic path are located on a same side of the headphones.

19. Headphones comprising:

a first acoustic path configured to provide passive noise cancellation;

a second acoustic path configured to provide audio leaking; and a rear volume, wherein a bass port part of the second acoustic path is directly exposed to the ambient environment without passing via the rear volume, and wherein the first acoustic path and the bass port are located on a same side of the headphones.

20. The headphones of claim 19, comprising a driver unit, wherein the driver unit comprises the bass port; and a front volume, wherein the front volume is separated from the rear volume at least in part by the driver unit, and wherein the front volume is separated from the ambient environment at least in part by the bass port.

* * * * *